US005265772A

United States Patent [19]

Bartasevich et al.

[11] Patent Number: 5,265,772

[45] Date of Patent: Nov. 30, 1993

[54] DISPENSING APPARATUS WITH TUBE LOCATOR

[75] Inventors: William E. Bartasevich, Kent; Ronald F. Bell, Uniontown; Joseph S. Kanfer, Richfield; Robert L. Waldo, Southington; J. Christopher Wysocki, Stow, all of Ohio

[73] Assignee: GOJO Industries, Inc., Cuyahoga Falls, Ohio

[21] Appl. No.: 963,388

[22] Filed: Oct. 19, 1992

[51] Int. Cl.[5] ..... B65D 35/28

[52] U.S. Cl. ..... 222/214; 222/153; 222/156; 222/181

[58] Field of Search ..... 222/105, 181, 182, 183, 222/156, 157, 153, 207, 214

[56] References Cited

U.S. PATENT DOCUMENTS

| | | | |
|---|---|---|---|
| Re. 24,312 | 5/1957 | Lippman et al. | 222/181 |
| 2,660,395 | 11/1953 | Mair et al. | 251/5 |
| 2,772,817 | 12/1956 | Jauch | 222/207 |
| 2,815,994 | 12/1957 | Lippman et al. | 309/23 |
| 2,993,626 | 7/1961 | Gildersleeve | 222/214 |
| 3,081,911 | 3/1963 | Scholle | 222/107 |
| 3,089,622 | 5/1963 | Westlake, Jr. | 222/183 |
| 3,117,695 | 1/1964 | Cox, Jr. | 222/105 |
| 3,232,496 | 2/1966 | Rockwell, Jr. et al. | 222/309 |
| 3,741,439 | 6/1973 | Vehrs | 222/103 |
| 3,768,704 | 10/1973 | Beguin | 222/207 |
| 3,870,201 | 3/1975 | Asplund | 222/207 |
| 4,018,363 | 4/1977 | Cassia | 222/80 |
| 4,130,224 | 12/1978 | Norman et al. | 222/185 |
| 4,256,242 | 3/1981 | Christine | 222/207 |
| 4,349,133 | 9/1982 | Christine | 222/183 |
| 4,391,308 | 7/1983 | Steiner | 141/18 |
| 4,391,309 | 7/1983 | Steiner | 141/18 |
| 4,394,938 | 7/1983 | Frassanito | 222/207 |
| 4,515,294 | 5/1985 | Udall | 222/207 X |
| 4,607,764 | 6/1986 | Christine | 222/207 |
| 4,621,749 | 11/1986 | Kanfer | 222/153 |
| 4,667,854 | 5/1987 | McDermott et al. | 222/214 X |
| 4,715,517 | 12/1987 | Potter et al. | 222/214 X |
| 4,741,461 | 5/1988 | Williamson et al. | 222/214 X |
| 4,895,276 | 1/1990 | Maldonado | 22/214 X |
| 5,174,476 | 12/1992 | Steiner et al. | 222/207 X |

*Primary Examiner*—Kevin P. Shaver
*Attorney, Agent, or Firm*—Reese Taylor

[57] ABSTRACT

A dispenser for dispensing soap from a container including a flexible, collapsible tube in fluid communication with the container. The dispenser includes a back plate which has a cover pivotally connected to it for movement between open and closed positions. The cover has a recessed front surface with an enlarged sight window for viewing the contents. The back plate receives the container and tube with the tube having fitments at its proximal and distal ends for mating engagement with complemental fitment locators on the back plate. The cover carries ramps which engage the fitments on closing to insure seating thereof. An output restrictor is releasably received on the back plate for limiting the stroke of a pressure applying handle carried by the cover.

19 Claims, 8 Drawing Sheets

DISPENSING APPARATUS WITH TUBE LOCATOR

BACKGROUND OF THE INVENTION

This invention relates in general to the art of dispensing fluid materials and particularly relates to a dispenser for dispensing viscous or granular material from a replaceable container including a collapsible, resilient tube, the container being receivable within the dispenser.

DESCRIPTION OF THE PRIOR ART

The general art of dispensing material of this type is rather voluminous in terms of various known types of counter- and wall-mounted dispensers capable of dispensing a measured dose of various materials, such as, for example, soap, upon the application of hand pressure to a dispensing arm or pressure member. The present invention may be generally considered to involve this genus of dispensers and more particularly of the wall-mounted type.

Moreover, while the present invention is directed primarily to a wall-mounted dispenser assembly for dispensing soap or similar materials onto the hand of a user and, for the sake of simplicity, will be illustrated and described as such, it will be readily apparent that the inventive concept involved herein and the operational features thereof need not be limited to the dispensing of any particular material.

The soap dispensing art has evolved from rigid cartridges from which the soap or other material is dispensed by utilizing various valving and follower plate arrangements to, at least in some applications, containers sometimes referred to as "bag-in-box" containers which involved a collapsible, flexible pouch generally stored in a rigid or semi-rigid box which is, in turn, removably placed inside the dispenser. Examples of the follower plate/valve type can be seen in Lippman U.S. Pat. No. Re. 24,312 and Lippman U.S. Pat. No. 2,815,994, while examples of bag-in-box containers can be seen in Scholle U.S. Pat. No. 3,081,911; Westlake U.S. Pat. No. 3,089,622; and Cox U.S. Pat. No. 3,117,695.

It is typical of many of the latter types of containers to include a collapsible tube projecting from the collapsible, flexible pouch which, in conjunction with pivoting pressure arms or members carried on the dispensing apparatus itself, dispense a predetermined amount of the material upon the application of collapsing pressure to the tubes. Further examples of this art can be seen in Mair U.S. Pat. No. 2,660,395; Jauch U.S. Pat. No. 2,772,817; Gildersleeve U.S. Pat. No. 2,993,626; and Rockwell U.S. Pat. No. 3,232,496.

The art has further developed to the point wherein containers of the bag-in-box type referred to above are combined with wall-mounted dispensers which include various designs of pressure members for collapsing the tubes and forcing a measured amount of material onto the hand of the user. Examples of this art may be seen in Vehrs U.S. Pat. No. 3,741,439; Beguin U.S. Pat. No. 3,768,704; Asplund U.S. Pat. No. 3,870,201; Cassia U.S. Pat. No. 4,018,363; Norman U.S. Pat. No. 4,130,224; Christine U.S. Pat. No. 4,256,242; Christine U.S. Pat. No. 4,349,133; Steiner U.S. Pat. No. 4,391,308; Steiner U.S. Pat. No. 4,391,309; and Frassanito U.S. Pat. No. 4,394,938.

Perhaps the best exemplar of dispensing combinations of this type can be seen in Kanfer U.S. Pat. No. 4,621,749 wherein the dispenser disclosed includes a back plate for wall mounting and a cover hingedly connected to the back plate and movable between open and closed positions with respect thereto.

A normally concealed but accessible latch mechanism is carried by the back plate and the cover for releasably securing the cover in its closed position. The back plate also has an integral shelf for reception of the container and has a tube-receiving member for seating the tube. A dispensing bar is hingedly mounted on the back plate, carrying a resiliently-mounted pressure member which can be normally urged into engagement with the tube and toward the back plate and is further movable into collapsing relationship therewith upon the application of hand pressure to the dispensing bar. Further, the cover of this combination has a through opening whereby the dispensing bar is accessible when the cover is in the closed position and the tube projects through an opening in the bottom for depositing the soap on the hand of the user.

While the prior art referred to above, and particularly that of the just mentioned Kanfer patent, has found widespread commercial acceptance, it is believed that still further improvements can be made and are desirable to be made.

For example, a sight window is normally provided in the cover so that, at least theoretically, one may observe the pouch to gauge the amount of soap remaining. However, these windows generally are of insufficient size to admit sufficient ambient light to permit this to be effectively accomplished.

It is also often the case that the collapsible tube is not precisely positioned prior to closing the cover leading to mislocation of the flexible bag and collapsible tube relative to the sight window and resulting in inadvertent crimping of the tube. This also may lead to failure to fully seat the tube and mislocating it relative to the pressure member, thereby affecting the accuracy of the dosage dispensed during each operating stroke.

Furthermore, it is sometimes desirable to alter the dosage amount dispensed on each operating stroke without any major modification of the structure to permit the end user to control soap usage.

Finally, many of the prior art dispensers are functional under ideal conditions and with careful usage. However, realistically, many are not ergonomically designed to optimally accommodate the user's hand leading to either an incomplete or only partially effective dispensing stroke or misdirected dispensing of the soap.

SUMMARY OF THE INVENTION

Accordingly, one object of this invention is to improve the sight window in the cover to permit full observation of the material level in the container. With the prior art, it has been found that the normal sight window, which lies flush with the cover surface, does not always admit adequate ambient light to precisely observe the contents. It has, therefore, been found and becomes an object of this invention to provide a recessed and enlarged sight window, making it possible to more accurately gauge the amount of material remaining in the disposable container part of the combination.

A further object of the present invention is to provide a dispenser which will securely and accurately seat the collapsible tube. It has, therefore, been found that by providing fitment means at both the top and bottom of the tube and complemental locating means on the front face of the container supporting shelf, such misalignment can be avoided and the tube and/or the bag itself may be properly aligned with the sight window.

Further in accordance with the above-stated object, in the prior art, it has been found that when the collapsible container is positioned in the dispenser and the cover is closed, the tube can be pinched off as the cover is closed. To that end, it has been discovered advantageous to provide camming means on the cover which will serve to force the tube into proper engagement with its seating area in the body of the dispenser upon closing of the cover.

A further object of the invention is to provide means for easily varying the dosage dispensed on each stroke of the pressure member. To that end, it has been found that a removable restrictor member can be provided which can be readily and easily replaced in the combination so as to effectively limit the movement of the pressure member, the degree of tube collapse and thus the output on each stroke.

Finally, it is an object of the invention to provide improved ergonomics to insure full and effective utilization of the pressure member and accurate direction of the soap dispensed from the tube. To that end, it has been found that if the pressure member, which is engaged by the heel of the hand, is spaced from a finger receiving recess and the dispensing end of the tube is disposed between the pressure member and finger receiving recess, simply engaging these surfaces and moving the heel of the hand toward the fingers will insure that the pressure member stroke is properly completed and the soap is deposited in the palm of the hand.

Accordingly, production of an improved dispensing apparatus of the type above-described becomes the principal object of this invention with other objects thereof becoming more apparent upon a reading of the following brief specification considered and interpreted in view of the accompanying drawings.

BRIEF DESCRIPTION OF THE PREFERRED EMBODIMENTS

Figure 1:
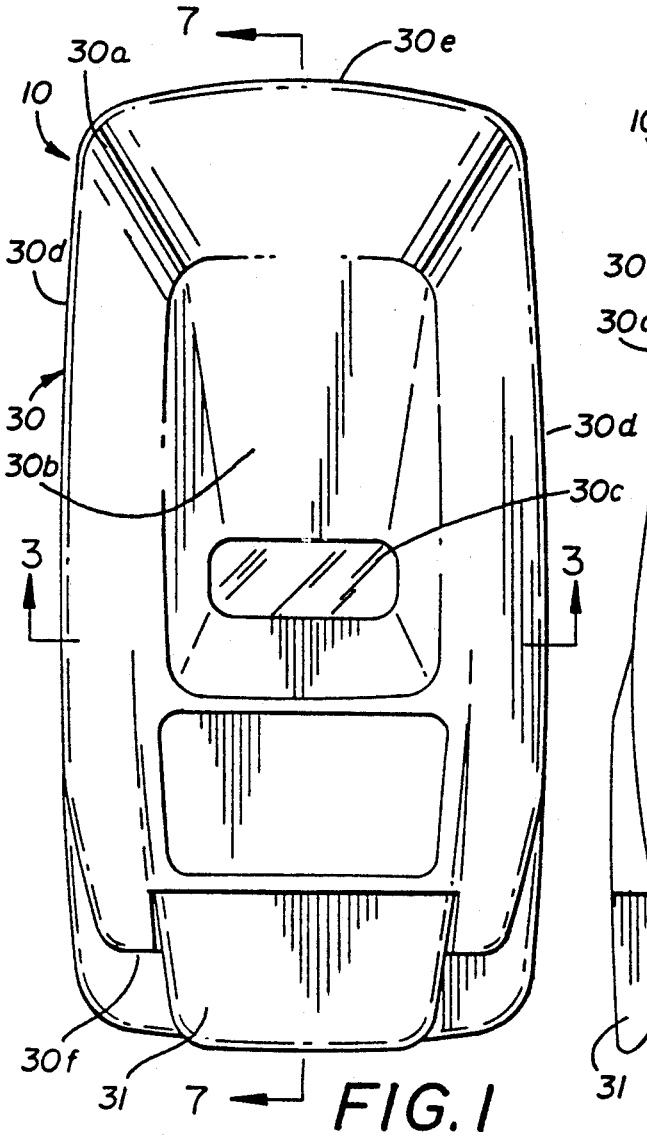
FIG. 1 is a front elevational view of the improved dispenser.
Figure 2:
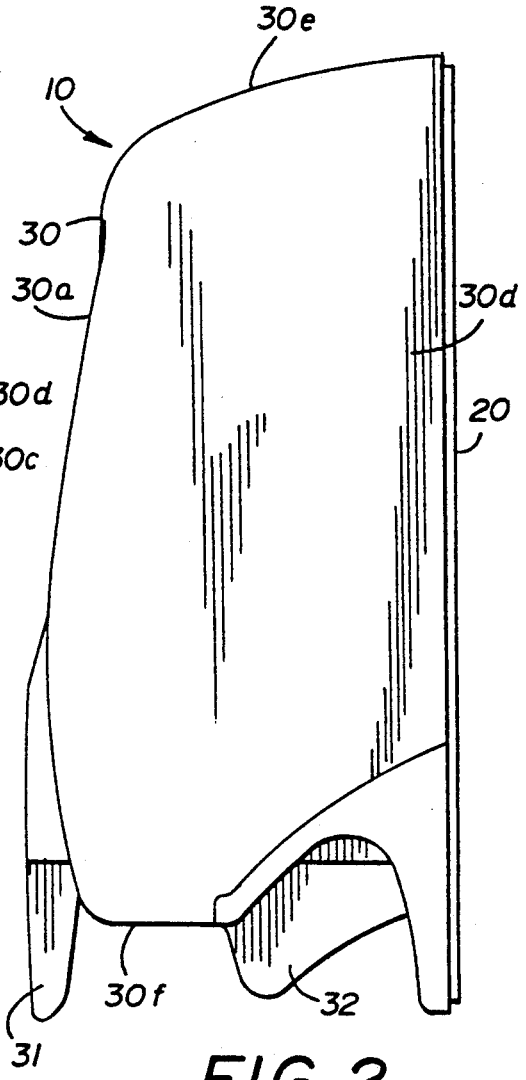
FIG. 2 is a side elevational view thereof showing the cover closed and in engagement with the back plate.
Figure 4:
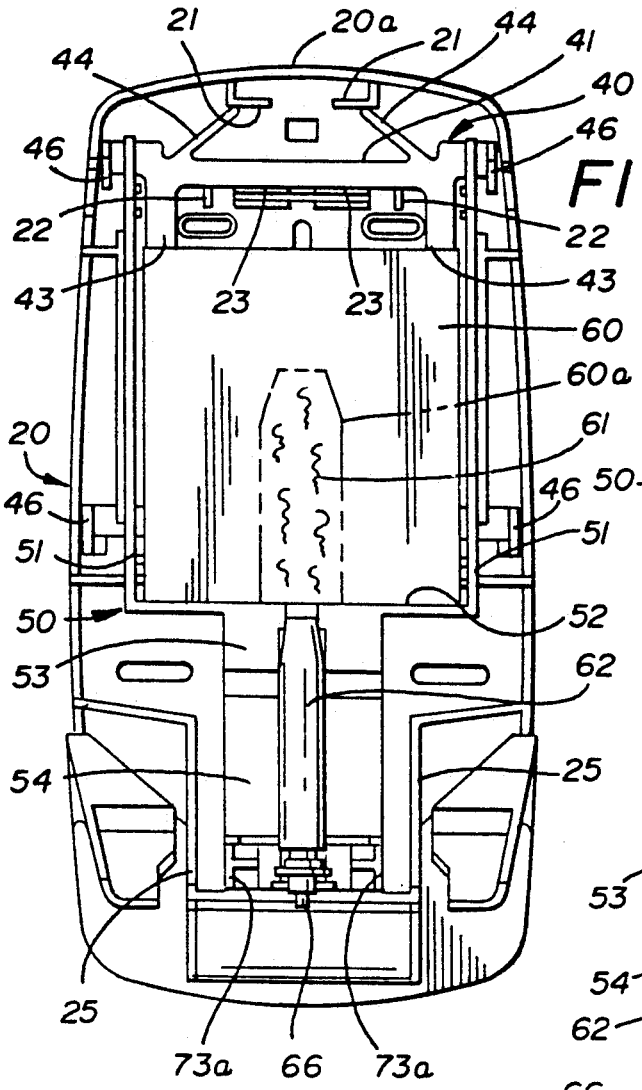
FIG. 4 is a front elevational view of the back plate with the cover removed and the container for the material in place.

Referring first, then, to FIGS. 1, 2 and 4 of the drawings, it will be seen that the dispenser 10 generally includes a back plate 20, a front cover 30, a latch plate 40 and a container and tube support 50.

Still referring to FIGS. 1 and 2 of the drawings, it will be seen that the front cover 30 includes a front face **30*a* and a recessed front surface portion 30*b* which receives the sight window 30*c* and which enables one to observe the interior of the dispenser when the cover 30 is in the closed position. It will be noted from FIG. 4, for example, that this sight window is positioned such that, with the usual tear strip 60*a* removed from the box 60**, the collapsible bag will be readily visible.

Cover 30 also includes opposed side faces **30*d*,30*d*, a top face 30*e* and a bottom face 30*f*, all forming a unitary, molded cover carrying the pressure member 31**.

Figure 12:
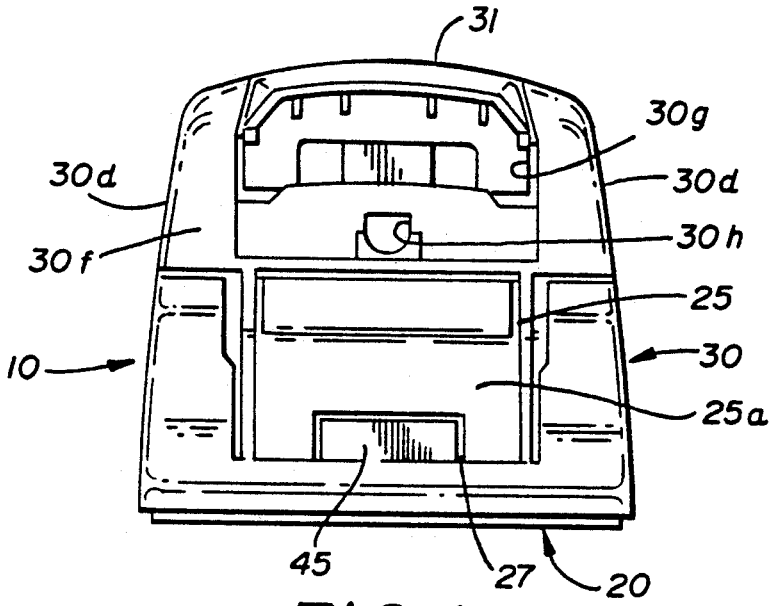
FIG. 12 is a bottom plan view of the dispenser in the closed position.

As can be seen in FIG. 12, bottom surface **30*f* has a transversely extending opening 30*g* through which pressure member 31 projects. This opening has a sufficient front to rear dimension to permit pressure member 31** to move through the required range of movement to collapse the tube and dispense the material as will be described below.

As can also be seen in FIG. 12, bottom surface **30*f* also has a second through opening 30*h*, centrally located with respect to side surfaces 30*d*,30*d*** for reception of the nozzle of the collapsible tube as will also be more fully described below.

Referring still to FIG. 2 and also FIGS. 6 and 11 of the drawings, it will be seen that the cover 30 further includes integral, spaced hinge arms 32,32 projecting inwardly from the rear surface of front face **30*a* and disposed adjacent bottom surface 30*f* for cooperation with back plate 20**, as will be described.

Finally, it will be noted, with reference to FIGS. 7, 8, 13 and 14, that pressure member 31 is pivotally secured to the inner surface of front face **30*a* of cover 30** so that it may move into and out of collapsing engagement with the collapsible tube as will be more fully described below.

Figure 7:
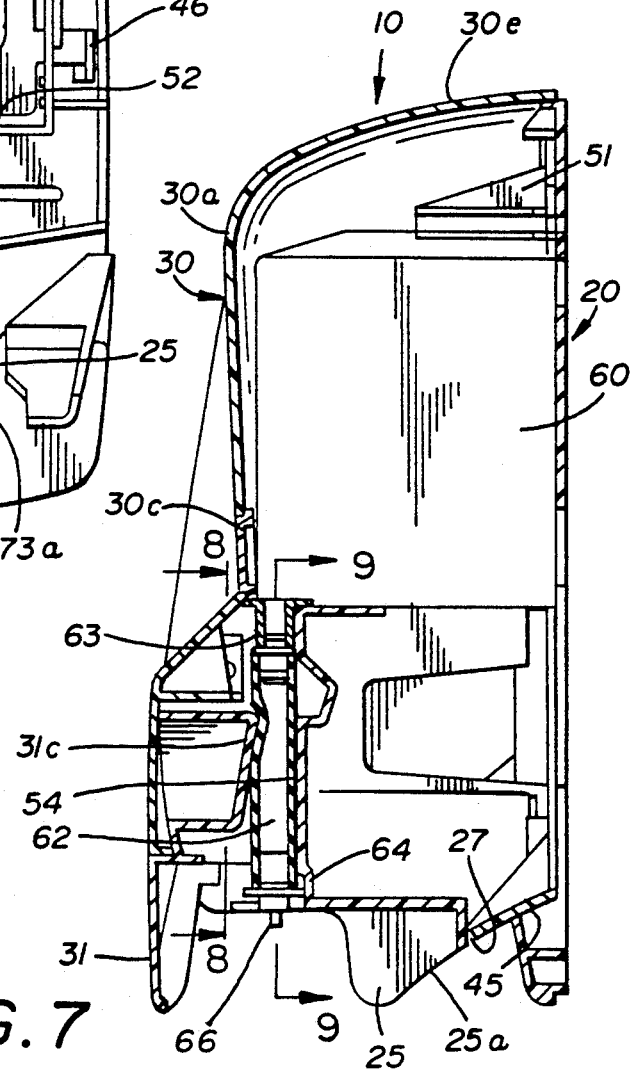
FIG. 7 is a sectional view taken along the line 7—7 of FIG. 1 with the pressure member in its inactive position.
Figure 8:
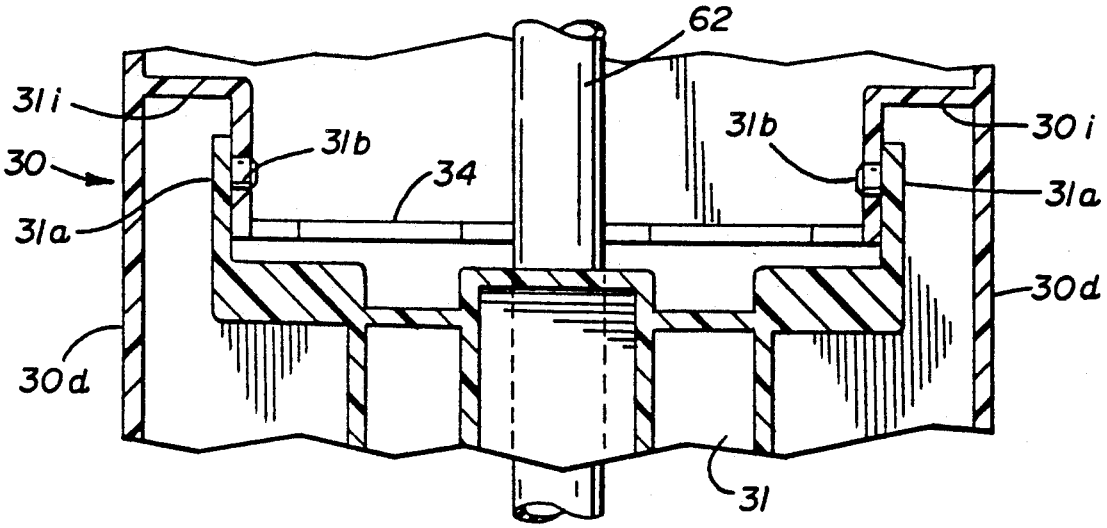
FIG. 8 is a sectional view taken along the line 8—8 of FIG. 7.
Figure 11:
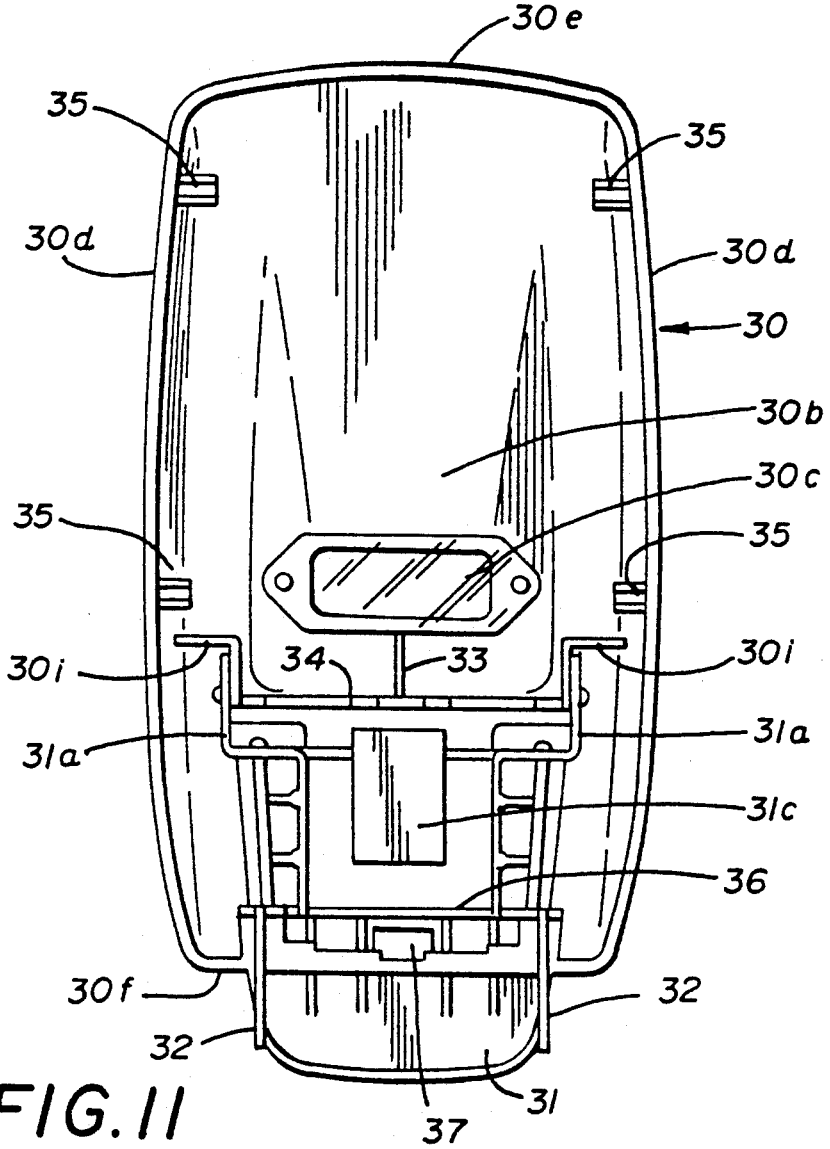
FIG. 11 is an elevational view taken from the rear or inner surface of the cover.

To that end, and referring to FIGS. 8 and 11 of the drawings, it will be seen that opposed support arms **30*i*,30*i* are provided on cover 30. Pressure member 31 has opposed legs 31*a*,31*a* which are pivotally connected to support arms 30*i*,30*i* by pins 31*b*,31*b* for pivotal movement relatively of cover 30 as can be seen, for example, in FIGS. 7, 13 and 14**.

It will also be noted, with reference to FIGS. 8 and 11 of the drawings, that cover 30 also has a centrally disposed top fitment ramp 34 and a top fitment locating rib 35. It also carries a lower fitment ramp 36, all of which serve to fully locate the tube and its accompanying fitments when cover 30 is moved to the closed position of FIGS. 2, 7, 13 and 14 as will be described below.

Figure 5:
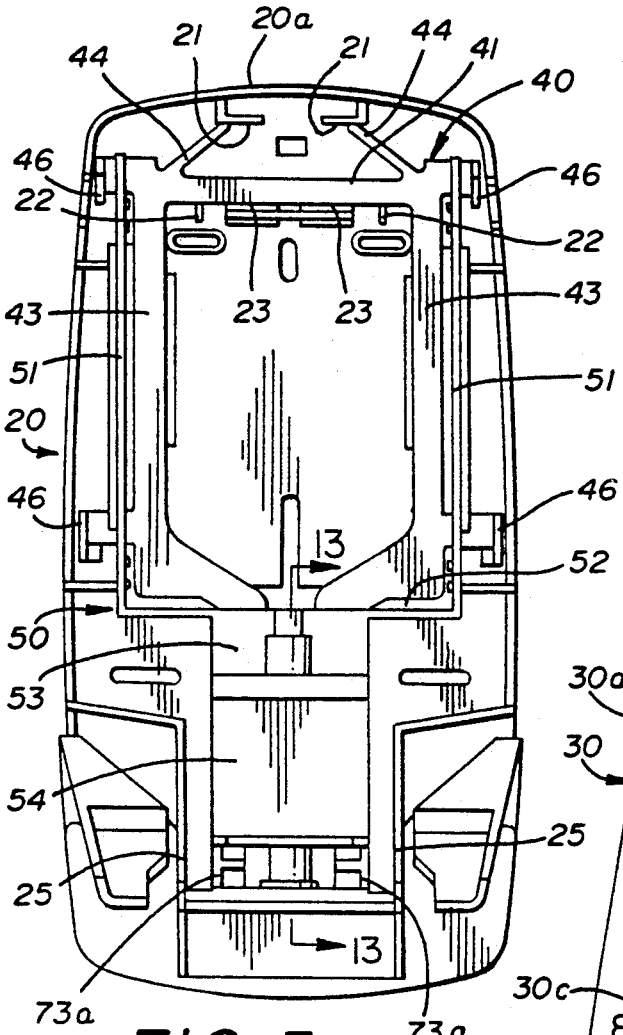
FIG. 5 is a view similar to FIG. 4 with the container for the material removed.
Figure 10:
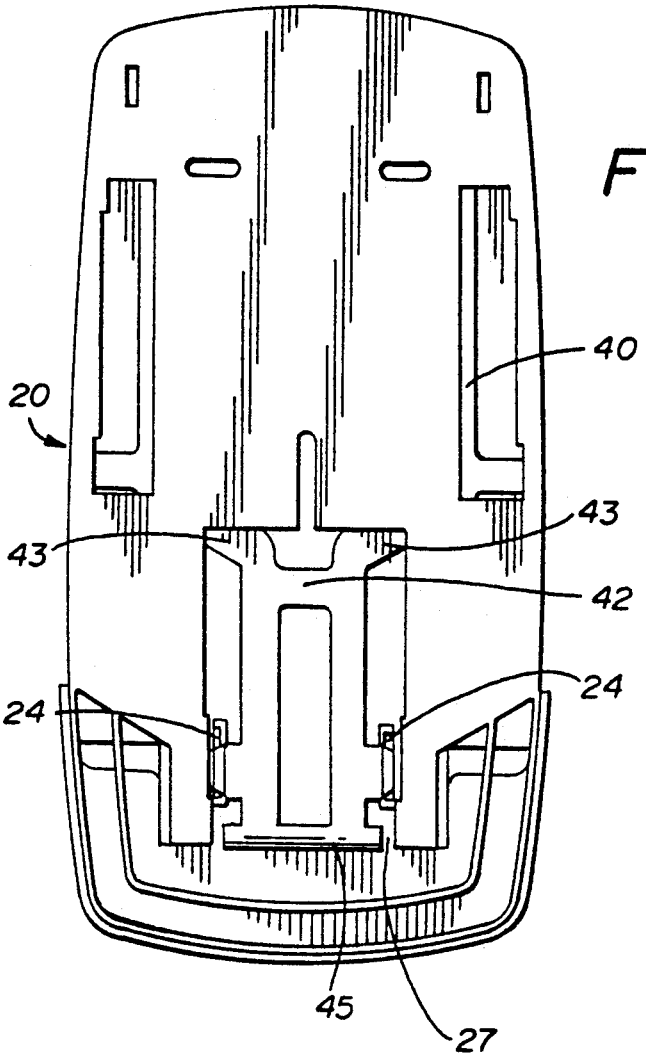
FIG. 10 is an elevational view taken from the rear of the dispenser showing the exposed or outer surface of the back plate.
Figure 9:
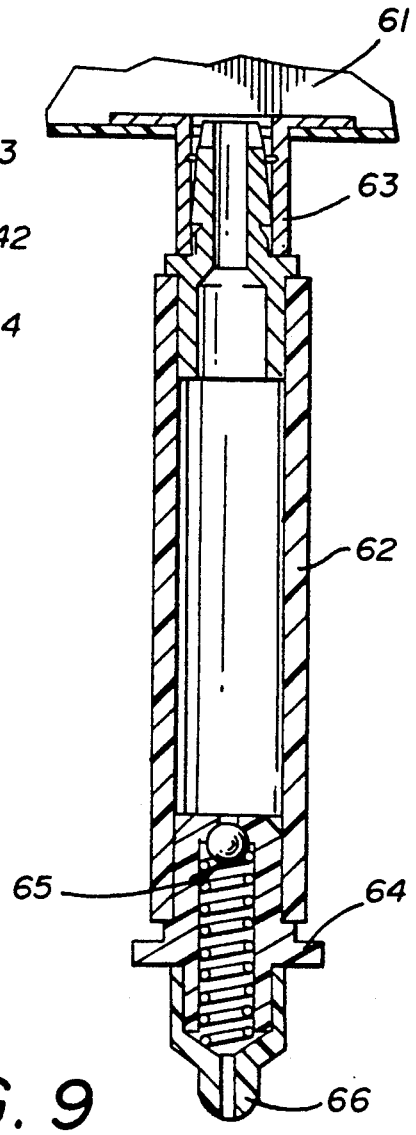
FIG. 9 is a sectional view taken along the line 9—9 of FIG. 7.

Referring to FIGS. 4 and 5 of the drawings, it will be seen that the back plate 20 includes first spring loading surfaces 21,21 projecting outwardly therefrom and disposed adjacent its top wall 20*a* for cooperation with the latch plate 40, as will be described below. The back plate 20 also includes a first set of stop members 22,22 and 23,23 also projecting outwardly therefrom and which also cooperate with the latch plate 40 to limit downward movement thereof relatively of back plate 20, as will also be described. Second stop surfaces 24,24 also are provided on back plate 20 for cooperation with latch plate 40 to limit upward movement thereof (see FIG. 10).

Figure 6:
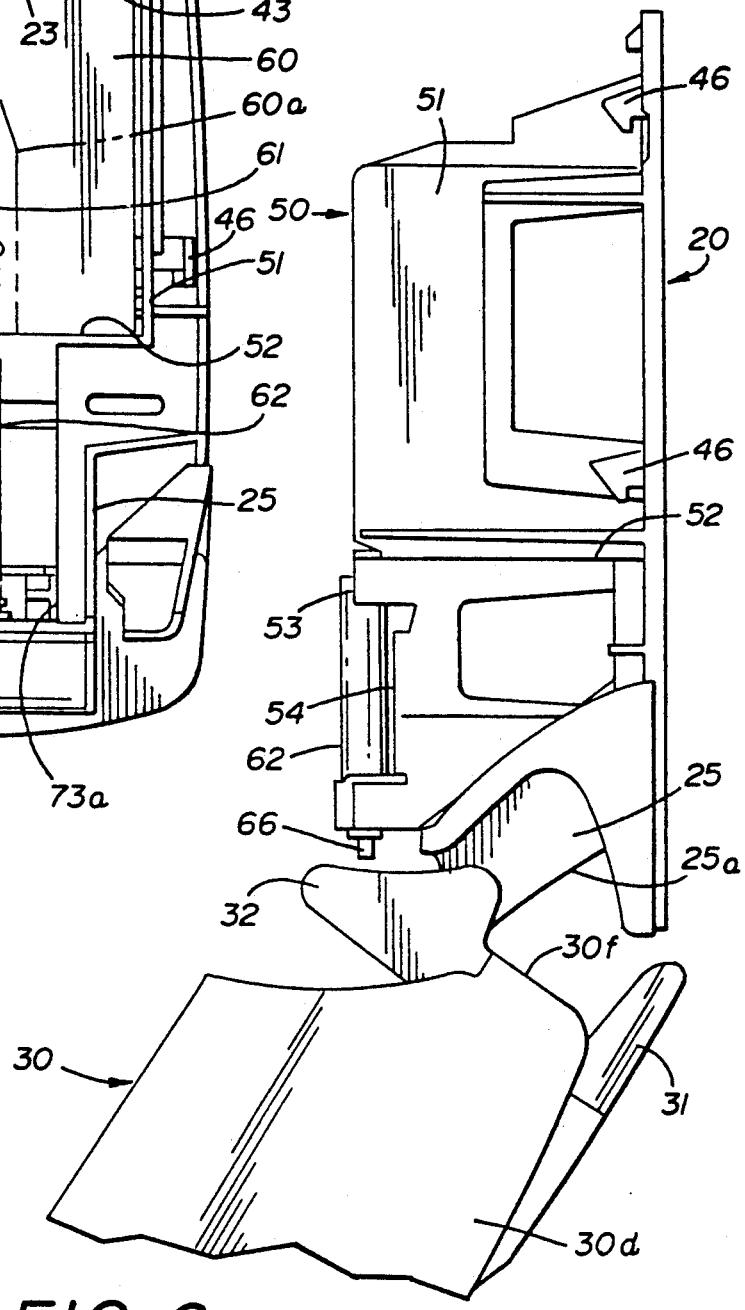
FIG. 6 is a side elevational view with the cover in the open position.

As can be seen in FIGS. 4 and 6, also projecting from the back plate 20, adjacent its lower end, are pivot supports 25,25 which interconnect in pivoting relationship with the hinge arms 32,32 of the cover, thereby enabling the cover 30 to swing from the closed position of, for example, FIGS. 1 and 2 to the open position of FIG. 6 relatively of the back plate 20. These pivot supports also have an outer arcuate surface 25*a* spaced from back plate 20 for engagement by the fingers of the user as will be described below.

Referring to FIGS. 4 and 5, the latch plate 40 is received in juxtaposed relationship with the back plate 20 and includes an upper cross member 41 and an intermediate cross member 42 (see FIG. 10) with the upper and intermediate cross members being interconnected by side members 43,43. Projecting from and integral with the upper cross member 41 are opposed spring arms 44,44 which are designed to cooperate with top spring loading surface 21 of the back plate 20, as will be described.

Figure 3:
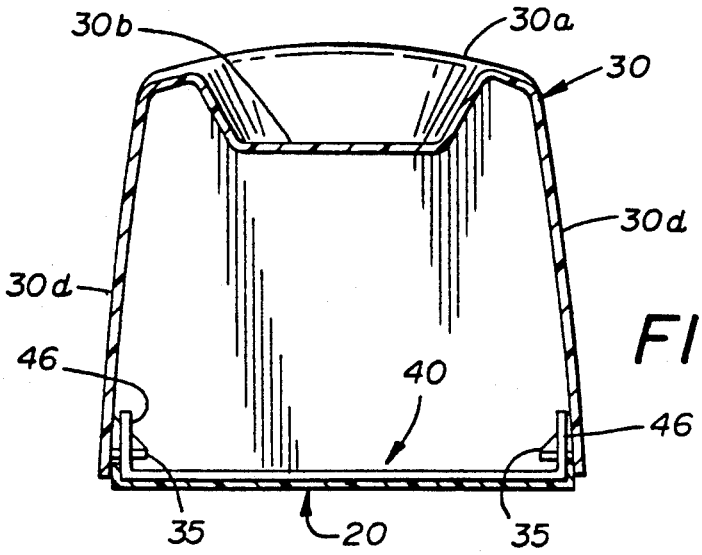
FIG. 3 is a sectional view taken along the line 3—3 of FIG. 1.

The latch plate 40 also has a transversely extending, projecting bottom cross member or extension 45 intended to be accessible when the cover 30 is closed through opening 27 in back plate 20 (see FIGS. 7, 10, 12, 13 and 14). Also, at the opposed ends of the upper cross member 41 and adjacent the lower ends of side members 43,43 are opposed lock tabs 46,46, illustrated in FIGS. 3 through 6, which cooperate with locking ears 35,35 of cover 30 illustrated in FIGS. 3 and 11. In that fashion, if the latch plate 40 has bottom cross member or extension 45 forced upwardly by finger pressure, the spring arms 44,44 will flex, enabling the lock tabs 46,46 to clear the locking ears 35,35, thereby permitting the cover 30 to be released and moved, for example, from the FIG. 1 to FIG. 6 position. As previously noted, first stop members 22,22 and 23,23 and second stop surfaces 24,24 limit travel of latch plate 40 to prevent damage thereto.

Referring next to FIG. 4 of the drawings, it will be seen that the material container, generally indicated by the numeral 60, is of the conventional "bag-in-box" construction and includes interiorly thereof a flexible, collapsible bag 61 which contains the material to be dispensed and which can be seen through tear strip opening 60*a*. A collapsible tube 62 extends from the bottom of the bag and carries on it upper and lower fitments 63 and 64 which cooperate with container and tube support 50 of the back plate structure 20 to properly locate and position the tube, as will be described more fully below. The tube also has the usual ball check valve 65 and nozzle 66. As previously described, nozzle 66 projects through aperture 30*h* in cover 30 when tube 62 is in place. It will be understood by those skilled in this art that the tube 62 is normally stored within the box during shipping and storage and that a tear strip is provided in the box so that, when the box is to be installed in the dispenser, the tear strip is simply removed along line 60*a* and the tube 62 extracted and the box and tube properly positioned in the dispenser.

To that end, it will be noted that a container and tube support member 50 projects outwardly from the back plate 20, and includes opposed side walls 51,51 and a bottom support shelf 52. It is clear from examination of FIG. 4 of the drawings that the container 60 for the material can easily rest on the support shelf 52 with the tube 62 depending therefrom. It will also be clear that sidewalls 51,51 serve to locate box or container 60 to avoid interference with cover 30.

Figure 15:
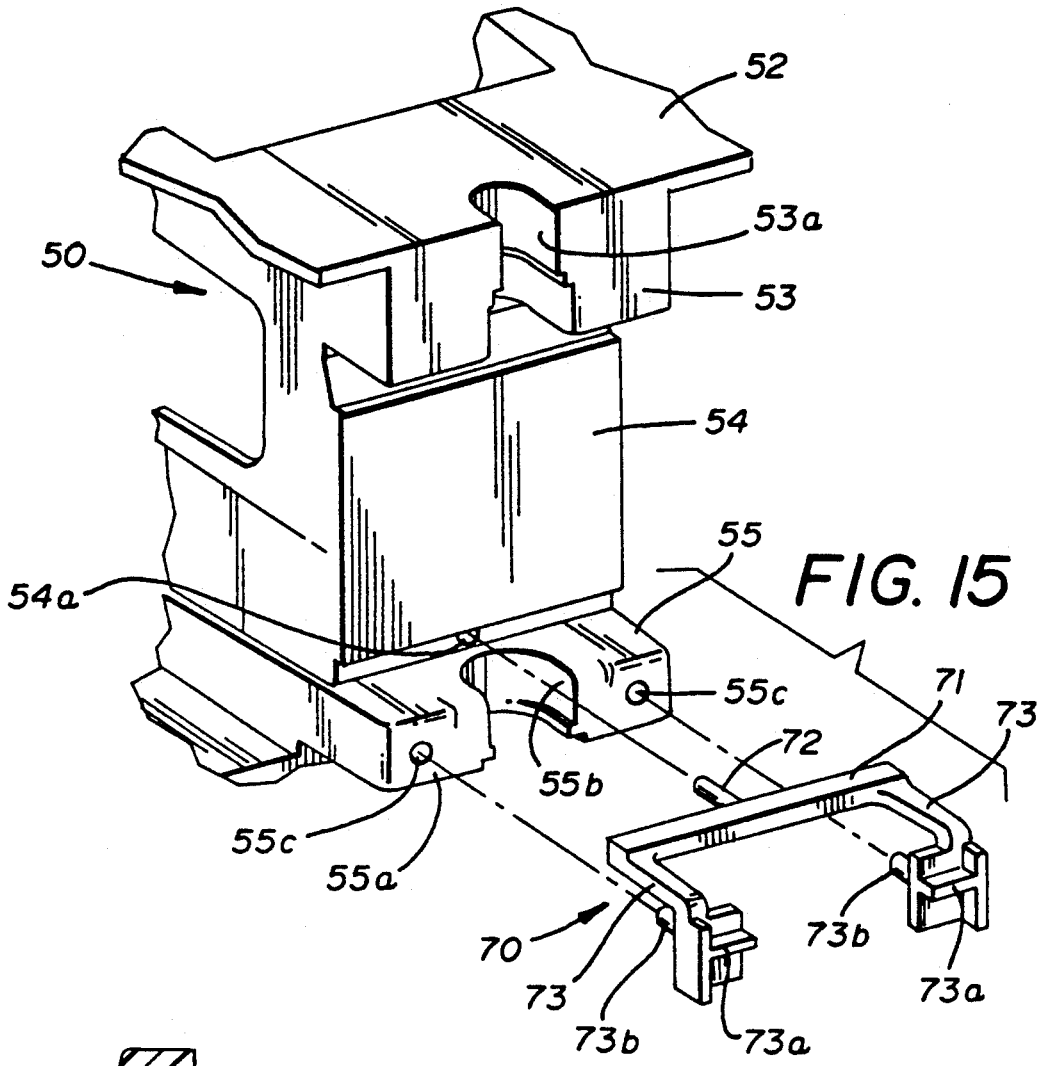
FIG. 15 is an exploded perspective view showing the restrictor.
Figure 16:
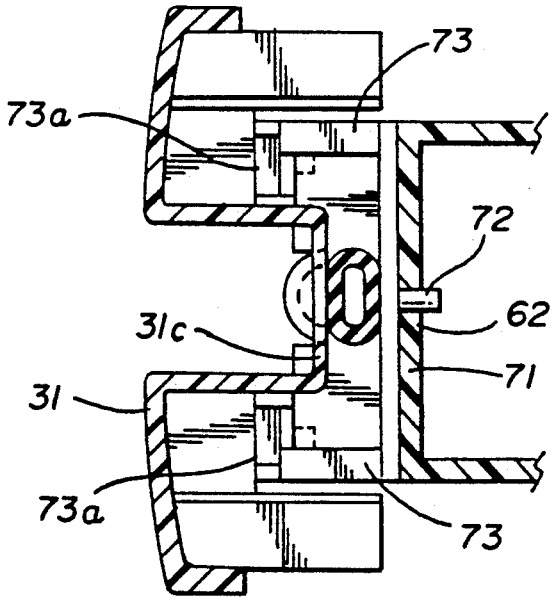
FIG. 16 is a sectional view taken along the line 16—16 of FIG. 13.

Still referring to FIG. 4 and also to FIG. 15, the container and tube support member 50 also includes a first vertical wall 53 and a second, recessed, vertical pressure support wall 54 extending downwardly from support shelf 52 and against which the tube 62 can be collapsed upon actuation of the pressure member 31. Extending outwardly from the bottom of container and tube support 50 is a projecting portion 55 having a front face 55*a* lying in substantially the same vertical plane as first vertical wall 53.

First vertical wall 53 includes an upper tube locator recess 53*a* located just beneath the bottom support shelf 52 for receipt of upper fitment 63 and a lower locator recess 55*b* in the front face 55*a* of projecting portion 55 for receipt of lower fitment 64. These recesses 53*a*,55*b* are configured to mate with the upper and lower fitments 63 and 64 on the tube 62 so that, when fully engaged, the tube 62 will be precisely retained.

Referring particularly to FIG. 15, it will be seen that a dose restrictor, generally indicated by the numeral 70, is releasably received on the front face 55*a* of projecting portion 55 adjacent the bottom locator recess 55*b*. The restrictor 70 includes a cross bar 71 and a rearwardly projecting, dowel-like locator 72. It also includes forwardly projecting parallel arms 73,73 which are generally L-shaped and terminate in axially projecting stop members 73*a*,73*a*. To the rear of the stop members 73*a*,73*a*, rearwardly projecting, dowel-like locators 73*b*, 73*b* are positioned. The pressure support wall 54 has a suitable aperture 54*a* for receipt of locator 72 and the front face 55*a* of projecting portion 55 has similar apertures 55*c*,55*c* for receipt of the dowel members 73*b*,73*b* so that, as will be readily apparent, the restrictor 70 can be easily fit into or out of the container and tube support 50. As will be described below, if variably lesser dosages are desired upon each stroke of pressure member 31, it is a simple matter to provide a different size of restrictor 70 which will thereupon limit the arcuate movement of the pressure member 31 and thereby less fully collapse the tube, thereby variably reducing the amount of material dispensed upon each operation of the dispenser.

It will be apparent that the projecting stop members 73*a*,73*a* of restrictor 70 will control or limit the range of collapsing movement of pressure member 31 and hence the amount of collapse of the tube 62 achieved thereby. This will, of course, affect the dose dispensed on each stroke.

Referring to FIG. 7 of the drawings, it will be seen that the dispenser combination is fully loaded and the pressure member 31 is in the at rest position with pressure pad 31*c* engaging tube 62. No dosage restrictor 73 is in place. Upon engaging pressure member 31 with the heel of the hand and surface 25*a* with the fingers, it will be appreciated that the palm of the hand will be positioned beneath nozzle 66.

Figure 14:
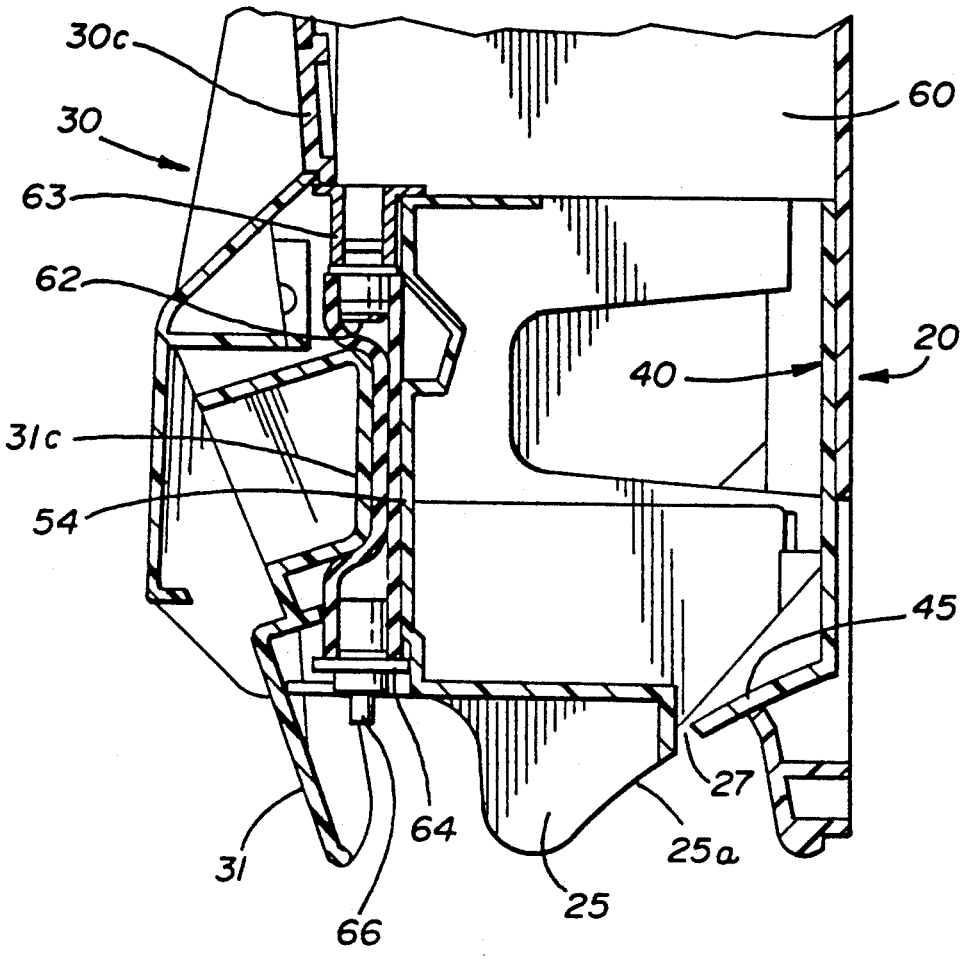
FIG. 14 is a view similar to FIG. 13 showing the pressure member in activated position without the stroke restrictor.

By exerting pressure on pressure member 31 and moving it to the FIG. 14 position, it will be seen that tube 62 will be collapsed and soap will be dispensed onto the palm of the user.

Figure 13:
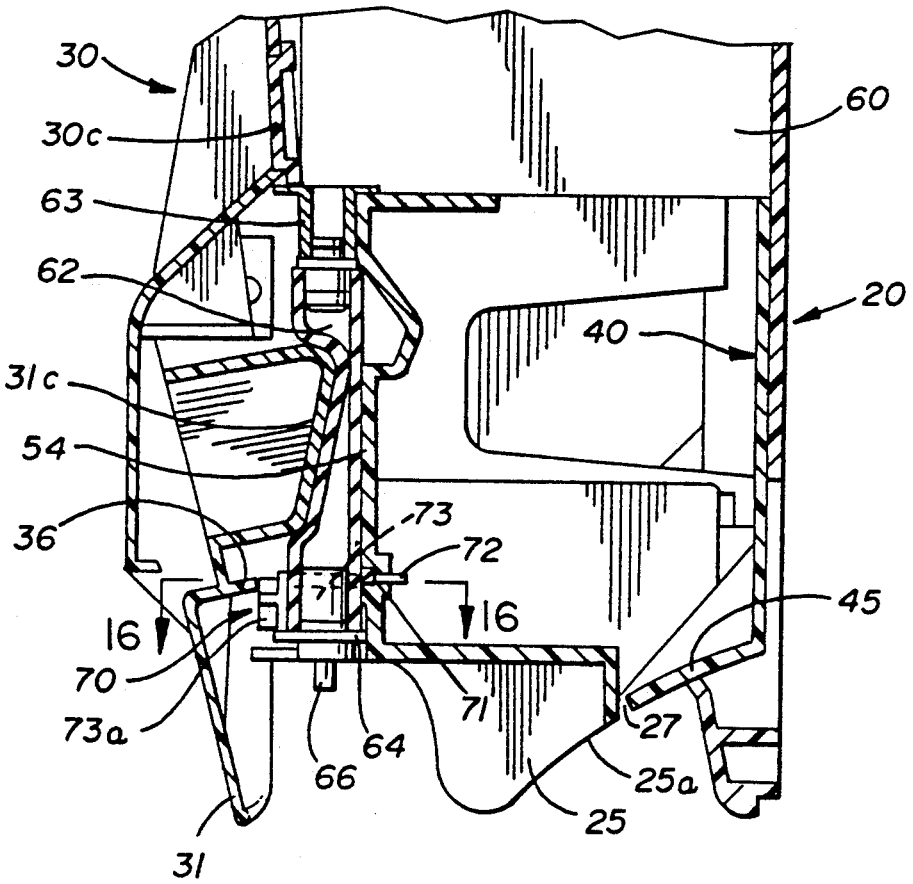
FIG. 13 is a partial sectional view taken along the line 13—13 of FIG. 5 showing the pressure member in activated position with the stroke restrictor in place.

Assuming a dosage restrictor 73 is in place and starting from the FIG. 7 position, the operation will result in movement to the FIG. 13 position wherein rib 36 of pressure member 31 contacts stop members 73*a*,73*a* and further collapse of tube 62 is prevented, thus limiting the dose dispensed.

It will also be noted that by employing the upper and lower tube fitment locator recesses 53*a*,55*b*, the upper and lower fitments 63 and 64 of the tube 62, which are complementally contoured to the locator recesses, will insure that the tube is firmly and accurately retained for efficient operation of the dispenser.

To assist in insuring proper seating of tube 62 and referring to FIGS. 8 and 11 of the drawings, it will be seen that the vertically depending, centrally disposed angled rib 33 provided on the inside of cover 30 and rib 34 and ramp 37 on the front cover 30 will insure that, should the tube 62 not be fully engaged with the fitment locators 53*a*,53*b* as the cover 30 is closed, the ramps and ribs will contact fitments 63 and 64 and force them into fully seated position. This insures the proper planned degree of collapse of tube 62 on each stroke of pressure member 31 and, thus, a proper dosage of material. The tube will be forced into a central position, thereby insuring proper registry of the same.

As previously mentioned, the present dispenser is configured to insure proper operation of the pressure member 31 and proper deposit of the soap from nozzle 66. To that end, and referring to FIGS. 2 and 7, it will be seen that pressure member 31 would be activated by engaging its outer surface with the heel of the hand and engaging sloping surface 25*a* of back plate pivot support 25 and closing the hand. Due to the location of nozzle 66, such movement will insure that the material will be accurately dispensed onto the user's palm as desired.

While a full and complete description of the invention has been set forth in accordance with the dictates of the Patent Statutes, it should be understood that modifications can be resorted to without departing from the spirit hereof or the scope of the appended claims.

What is claimed is:

1. A dispenser for dispensing fluid material from a container having an elongate, flexible dispensing tube attached to and projecting therefrom, comprising:

a) a back plate;

b) a cover attached to said back plate and movable between open and closed positions relatively thereof;

c) means carried by said back plate for supporting the container and the tube;

d) pressure means carried by said cover and being movable into engagement with the tube for collapsing the same and dispensing material therefrom;

e) first locator means carried by said back plate for engaging and locating the tube adjacent its point of attachment to the container;

f) second locator means carried by said back plate for engaging and locating the tube adjacent its distal end; and g) seating means for urging the tube into engagement with said first and second locator means.

2. The dispenser of claim 1 wherein said seating means are carried by said cover for engaging and locating the tube when said cover is moved into closed position.

3. The dispenser of claim 2 wherein the tube has a first fitment member adjacent its point of attachment to said container and a second fitment member adjacent its distal end; said seating means being moved into engagement with said first and second fitment means when said cover is moved to its closed position.

4. The dispenser of claim 3 wherein said seating means include a first locating means comprising a vertically disposed ramp projecting from the inner surface of said cover.

5. The dispenser of claim 3 or claim 4 wherein said seating means include a first locating means comprising a transversely extending rib projecting from the inner surface of said cover.

6. The dispenser of claim 3 wherein said seating means include a second locating means comprising a ramp projecting from the inner face of said cover.

7. The dispenser of claim 1 wherein an output restrictor is releasably mounted between said back plate and said cover to engage said pressure means and limit its range of movement with respect to the tube and the degree of tube collapse.

8. The dispenser of claim 7 wherein said means for supporting the container and the tube include a container and tube support carried on said back plate and having a tube supporting surface; said output restrictor being releasably carried by said container and tube support and projecting from said tube supporting surface toward said pressure means when said cover is in its closed position.

9. The dispenser of claim 8 wherein a projecting stop member is disposed on the inner surface of said pressure means and positioned to be in alignment with said output restrictor when said cover is in its closed position.

10. The dispenser of claim 1 wherein locking means are carried by said back plate and said cover for releasably retraining said cover in its closed position.

11. The dispenser of claim 1 wherein first and second fitment members are carried by the tube adjacent its proximal and distal ends; said first and second locator means and said first and second fitments being complementally configured.

12. The dispenser of claim 1 wherein said pressure means includes a pressure handle disposed adjacent the lower end of said cover when in its closed position; said back plate has a contoured bottom surface spaced from said handle when said cover is in its closed position; and the projecting end of the tube is disposed between said handle and said contoured bottom surface when said cover is in its closed position.

13. The dispenser of claim 1 wherein said cover has a first front face surface lying in a first plane, a recessed front face surface contiguous with said first front face surface and lying in a second plane offset therefrom; and a sight window disposed in said recessed front face surface; said sight window disposed in said front surface so as to be aligned with the bottom of the container when said cover is in closed position.

14. The dispenser of claim 1 wherein said third locating means are carried on said back plate for aligning the container with respect to the transverse dimension of said back plate; said third locating means include substantially parallel, spaced walls having a vertical dimension approximating that of the container.

15. A dispenser for dispensing fluid material from a container having an elongate, flexible dispensing tube attached to and projecting therefrom, comprising:

a) a back plate;

b) a cover attached to said back plate and movable between open and closed positions relatively thereof;

c) means carried by said back plate for supporting the container and the tube;

d) pressure means carried by said cover and being movable into engagement with the tube for collapsing the same and dispensing material therefrom;

e) first locator means carried by said back plate for engaging and locating the tube adjacent its point of attachment of the container;

f) second locator means carried by said back plate for engaging and locating the tube adjacent its distal end; and g) seating means carried by said cover for engaging and locating the tube when said cover is moved into closed position.

16. The dispenser of claim 15 wherein the tube has a first fitment member adjacent its point of attachment to said container and a second fitment member adjacent its distal end; said seating means being moved into engagement with said first and second fitment means when said cover is moved to its closed position.

17. The dispenser of claim 16 wherein said seating means include a first locating means comprising a vertically disposed ramp projecting from the inner surface of said cover.

18. The dispenser of claim 16 or claim 17 wherein said seating means include a first locating means comprising a transversely extending rib projecting from the inner surface of said cover.

19. The dispenser of claim 16 wherein said seating means include a second locating means comprising a ramp projecting from the inner face of said cover.

* * * * *

UNITED STATES PATENT AND TRADEMARK OFFICE

CERTIFICATE OF CORRECTION

PATENT NO. : 5,265,772

DATED : November 30, 1993

INVENTOR(S) : William E. Bartasevich et al.

It is certified that error appears in the above-identified patent and that said Letters Patent is hereby corrected as shown below:

In Column 7, line 26, delete "53a,53b" and substitute therefor ---53a,55b---;

In Column 8, line 43, delete "retraining" and substitute therefor ---retaining---; and In Column 9, line 18, delete "of" and substitute therefor ---to---.

Signed and Sealed this

Seventeenth Day of May, 1994

*Attest:*

Bruce Lehman

BRUCE LEHMAN

*Attesting Officer*

*Commissioner of Patents and Trademarks*

Disclaimer and Dedication 5,265,772 —William E. Bartasevich, Kent; Ronald F. Bell, Uniontown; Joseph S. Kanfer, Richfield; Robert L. Waldo, Southington; J. Christopher Wysocki, Stow, all of Ohio. DISPENSING APPARATUS WITH TUBE LOCATOR. Patent dated November 30, 1993. Disclaimer and dedication filed December 23, 1994, by the assignee, GOJO Industries, Inc.

Hereby disclaims and dedicates to the public the remaining term of said patent.

(*Official Gazette* September 5, 1995.)